US006179995B1

(12) United States Patent
Cash et al.

(10) Patent No.: US 6,179,995 B1
(45) **Date of Patent: *Jan. 30, 2001**

(54) RESIDUUM HYDROTREATING/ HYDROCRACKING WITH COMMON HYDROGEN SUPPLY

(75) Inventors: Dennis R. Cash, Novato; Martin J. Armstrong, Napa, both of CA (US)

(73) Assignee: Chevron U.S.A. Inc., San Francisco, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/227,235

(22) Filed: Jan. 8, 1999

Related U.S. Application Data

(60) Provisional application No. 60/078,012, filed on Mar. 14, 1998.

(51) Int. Cl.[7] ..... C10C 3/00; C10C 45/06; C10C 47/02

(52) U.S. Cl. ..... 208/89; 208/86; 208/108; 208/211; 208/212

(58) Field of Search ..... 208/86, 89, 108, 208/211, 212

(56) References Cited

U.S. PATENT DOCUMENTS

| | | | |
|---|---|---|---|
| 3,172,836 | 3/1965 | Robbers | 208/59 |
| 3,256,178 | 6/1966 | Hass et al. | 208/89 |
| 3,328,290 | 6/1967 | Hengstebeck | 208/89 |
| 3,489,674 | 1/1970 | Borst, Jr. | 208/108 |
| 3,546,094 | 12/1970 | Jaffe | 208/59 |
| 3,728,249 | 4/1973 | Antezana et al. | 208/57 |
| 3,779,897 | 12/1973 | Wrench et al. | 208/89 |
| 3,847,799 | 11/1974 | Munro | 208/210 |
| 4,082,647 | 4/1978 | Hutchings et al. | 208/78 |
| 4,197,184 | 4/1980 | Munro et al. | 208/89 |
| 4,283,272 | 8/1981 | Garwood et al. | 208/59 |
| 4,615,789 | 10/1986 | Bridge et al. | 208/143 |
| 4,720,337 | 1/1988 | Graziani et al. | 208/58 |
| 4,729,826 * | 3/1988 | Lindsay et al. | 208/211 |
| 5,009,768 | 4/1991 | Galiasso et al. | 208/89 |
| 5,114,562 | 5/1992 | Haun et al. | 208/89 |
| 5,290,427 | 3/1994 | Fletcher et al. | 208/89 |
| 5,382,349 | 1/1995 | Yoshita et al. | 208/49 |
| 5,403,469 | 4/1995 | Vank et al. | 208/78 |
| 5,522,983 | 6/1996 | Cash et al. | 208/59 |
| 5,603,824 | 2/1997 | Kyan et al. | 208/208 R |

FOREIGN PATENT DOCUMENTS

| | | |
|---|---|---|
| 787787A2 | 6/1997 | (EP) . |
| WO97/38066 | 10/1997 | (WO) . |

* cited by examiner

*Primary Examiner*—Walter D. Griffin
*Assistant Examiner*—Tam M. Nguyen
(74) *Attorney, Agent, or Firm*—Alan W. Klaassen; Penny L. Prater

(57) ABSTRACT

An integrated residuum hydroconversion process which includes a residuum hydrotreater and a desulfurized oil hydrocracker produces high quantities of high quality middle distillate fuels. Distillate range products from the residuum hydrotreater are hydrocracked, while catalyst fouling from heavy aromatics present in the hydrotreated products is minimized. The process includes a single hydrogen supply and recovery loop for increased cost and energy savings.

14 Claims, 1 Drawing Sheet

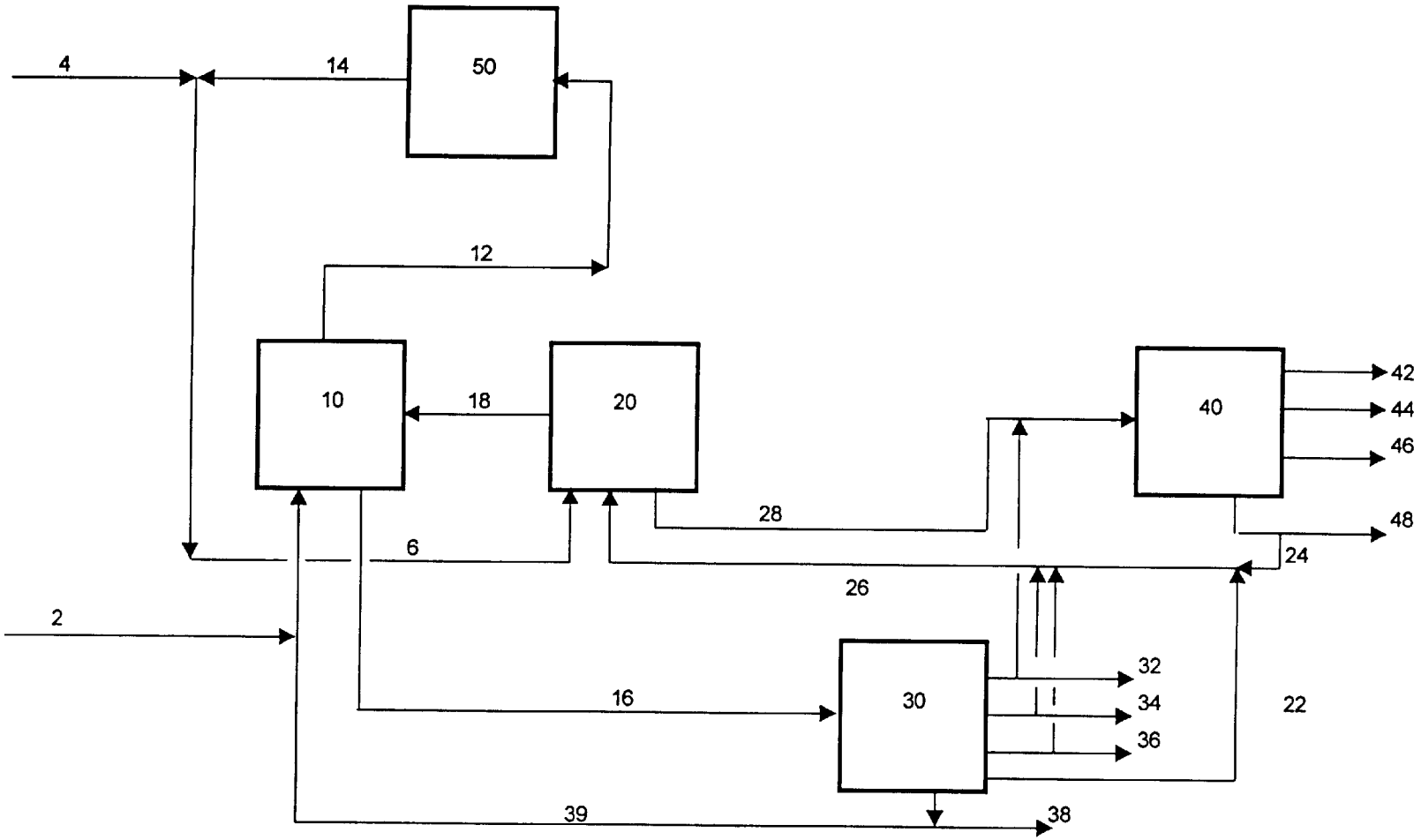
42
44
46
48
24
22
40
32
34
36
38
30
26
28
20
16
39
50
12
18
6
10
14
4
2

RESIDUUM HYDROTREATING/ HYDROCRACKING WITH COMMON HYDROGEN SUPPLY

This application claims priority from U.S. Provisional Application Serial No. 60/078012, filed Mar. 14, 1998, the entire disclosure of which is incorporated herein be reference for all purposes.

BACKGROUND OF THE INVENTION

The present invention is directed to an integrated process for upgrading a residuum feedstock by hydrotreating and hydrocracking using a common hydrogen supply system.

Some progress has been made in developing methods for using a single hydrogen loop in a two-stage reaction process. U.S. Pat. No. 5,009,768 teaches hydrodemetallizing a high-residual vacuum gas oil and hydroconverting the product from the first reaction zone at deep denitrogenation conditions in a second reaction zone. Cycle oil from an FCC may be added to the feed to the second reaction zone. U.S. Pat. No. 4,283,271 and U.S. Pat. No. 4,283,272 teach processes for making lubricating oil which include passing a suitable hydrocarbon feed and hydrogen sequentially through a hydrocracking zone, a catalytic dewaxing zone and a hydrotreating zone, all at high pressure and in that order, with purification of the hydrogen gas prior to passage to the dewaxing zone.

EP 787,787 discloses a hydroprocess in parallel reactors, with hydrogen flowing in series between the reactors. Effluent from a first reaction zone is separated into a first hydrogen rich gaseous stream and a first hydroprocessed product stream. The first hydrogen rich gaseous stream is shown as being used as quench for a second reaction zone. The first hydrogen rich gaseous stream is also combined with a second hydrocarbon feedstock and fed to the second reaction zone, at a lower hydrogen partial pressure than is the first reaction zone. Effluent from the second reaction zone is separated, the second hydrogen rich gaseous stream being recycled to the first reaction zone, both as a quench stream and as a reactant in combination with a first hydrocarbon feedstock.

Other methods have been proposed for separating partially reacted reactants within a reactor, removing one of the reacting streams (generally either a liquid or a vapor stream) and continuing reaction of the remaining stream. For example, U.S. Pat. No. 5,403,469 teaches a two-stage hydrocracking process, with denitrification being accomplished in the first conversion zone and cracking conversion being accomplished in the second conversion zone. U.S. Pat. No. 3,172,836, a liquid-vapor separation zone is located between two catalyst beds for withdrawing a normally gaseous fraction and a normally liquid fraction from a first catalyst bed. The normally gaseous fraction, along with a second normally liquid fraction, is then passed downwardly through a second catalyst bed. The normally liquid fraction passed through the second catalyst bed may be a liquid fraction recovered from a distillation of the effluent from the first catalyst bed. In U.S. Pat. No. 4,615,789 a liquid/vapor separator is utilized between catalyst beds to remove liquid from between the beds and permit vapor separated by the separator to pass through catalyst beds below the separator.

U.S. Pat. No. 5,603,824 teaches a reactor having at least a top bed containing a hydrocracking catalyst and a bottom bed containing a dewaxing catalyst. A hydrocarbon feed mixture is separated, with the heavier stream being hydrocracked in the top bed of the reactor and the lighter stream combined with the effluent from the top bed and the combination catalytically dewaxed in the bottom bed.

However, further improvements for reducing refinery operating costs using common hydrogen supply systems are desired.

SUMMARY OF THE INVENTION

Residuum feedstocks typically contain significant amounts of sulfur, nitrogen and highly unsaturated complex molecules termed "asphaltenes". The residuum feedstocks may also contain metal compounds, e.g. nickel and vanadium in particular with sometimes lesser amounts of other metals such as calcium, magnesium and iron. These contaminants are detrimental to many refinery processes, and especially to many catalytic processes. Therefore, it is imperative that these contaminants be removed from the residua prior to further processing, and that downstream catalysts not be degraded by contact with these contaminants.

The present invention is directed to a process for upgrading a residuum petroleum feedstock to useful finished products such as fuels or lubricating oil base stocks. In such a process, a number of upgrading steps are generally required. Hydrotreating, for example, removes metals from the feedstock, saturates olefins and aromatics, converts asphaltenes and removes sulfur and nitrogen. Specialized catalysts are required for converting the complex residuum molecules, many of which contain these contaminants. Asphaltenes are large, complex, asphaltic-type molecules with relatively low solubility, particularly in conversion products from a residuum conversion process. During processing, unconverted asphaltenes tend to precipitate and form plugs and obstructions in process equipment, in process lines, and on catalyst surfaces.

For processing a residuum to make fuels or lubricating oil base stocks, it is desirable to further reduce the molecular weight of a hydrotreated residuum by hydrocracking. However, residual amounts of asphaltenes in the hydrotreated residuum, or carried over in the hydrogen recovered from a residuum hydrotreating unit, quickly deactivate the hydrocracking catalyst, making conventional hydrocracking of a hydrotreated residuum difficult and expensive.

This problem is frequently addressed in conventional process by providing separate and distinct processes hydrotreating and hydrocracking processes, each with an independent and separate hydrogen system. Each system includes hydrogen recovery from the reactor effluent, hydrogen purification to remove ammonia, hydrogen sulfide and other contaminants, and hydrogen compression to return the hydrogen to reactor pressure for recycle. Having the two independent systems addresses the catalyst contamination problem, but at high equipment and operating cost.

It is desirable to have an integrated system for hydrotreating and hydrocracking a residuum feedstock at reduced risk of contaminating the hydrocracking catalyst while avoiding the duplication of a dual hydrogen recycle and recovery system.

Accordingly, the present invention is directed to an integrated hydroconversion process comprising:

- contacting a residuum feedstock with a hydrogen-rich gaseous stream in a hydrotreating reaction zone to form a hydrotreated liquid product having reduced asphaltene content and a gaseous hydrotreater effluent;
- fractionating the hydrotreated liquid product to recover at least a desulfurized VGO fraction;

contacting a VGO feed with a gaseous hydrocracker feed stream in a hydrocracking reaction zone, at hydrocracking conditions sufficient to effect a boiling range conversion of the VGO feed, to produce at least the hydrogen-rich gaseous stream and a liquid hydrocrackate;

passing the hydrogen-rich gaseous stream to the hydrotreating reaction zone for contacting with the residuum feedstock;

fractionating the liquid hydrocrackate to recover at least a VGO product stream; and combining the desulfurized VGO fraction with at least a portion of VGO product stream to form the VGO feed for contacting in the hydrocracking reaction zone.

In a preferred process, the hydrotreated gaseous effluent is purified in a recycle gas purifier to produce a purified recycle gas. The purified recycle gas is available as one of the sources of the gaseous hydrocracker feed stream, as one of the sources of quench fluid for the hydrotreating reaction zone, and/or as one of the sources of quench fluid for the hydrocracking reaction zone.

In the preferred process the hydrogen-rich gaseous stream recovered from the hydrocracking reaction zone is passed to the hydrotreating reaction zone at substantially the same temperature and at substantially the same pressure as the hydrocracking reaction zone. Under operating conditions such that the hydrotreating reaction zone is maintained at a temperature below that of the hydrocracking reaction zone and/or at a pressure below that of the hydrocracking reaction zone, the hydrogen-rich gaseous stream, in this preferred process, is reduced in temperature and/or in pressure to the extent needed to substantially match the temperature and/or the pressure of the hydrotreating reaction zone.

In a further preferred process of the invention, the hydrotreated liquid product from the hydrotreating reaction zone is fractionated in a first fractionation zone and the liquid hydrocrackate from the hydrocracking reaction zone is fractionated in a second fraction zone. At least a portion of one or more fractions from each or both of the fractionation zones may be recycled as a portion of the feedstream to the hydrocracking reaction zone.

Unlike conventional processes, the hydrocracker in the present process is an integral part of the residuum upgrading process, and, indeed, the hydrocracker and the residuum hydrotreater share a common hydrogen supply and recovery system. Among other factors, the present invention is based on the surprisingly reduced capital and operating costs of the present process relative to conventional processes. It is further based on the surprising discovery of the increased middle distillate yields and improved product properties which are realized with the present process.

BRIEF DESCRIPTION OF THE DRAWINGS

The FIGURE illustrates an embodiment of the invention with a residuum hydrotreating reactor and a hydrocracker using a single hydrogen supply and recovery system.

DETAILED DESCRIPTION OF THE INVENTION

The present invention is an integrated process for hydroconverting a residuum feedstock, preferably a vacuum residuum feedstock, to make increased quantities of a middle distillate fuel. The integrated process includes a hydrotreater and a hydrocracker, with a common hydrogen supply and recovery system serving both reactors. In the process, asphaltenes are effectively converted without deactivating the hydrocracking catalyst.

With reference to the specific embodiment illustrated in the FIGURE, residuum feedstock 2 is contacted with a hydrogen-rich gaseous stream 18 in a hydrotreating reaction zone 10. The hydrotreating reaction zone 10 may comprise a single reaction zone in a single reactor vessel. Generally, a plurality of reactor vessels, each containing one or more catalyst beds, are employed, with each catalyst bed being maintained at conditions sufficient to remove at least a portion of one or more of the contaminants contained in the feedstock, such as metals, asphaltenes, sulfur or nitrogen. Each catalyst bed may contain one or several different catalysts, each intended for effectively removing one or more of the contaminants.

In addition, the hydrotreating reaction zone 10 as shown in the FIGURE includes vessels for separating the hydrotreated effluent into at least one hydrotreated liquid product stream 16 and a gaseous hydrotreater effluent 12. Gaseous hydrotreater effluent 12 may optionally be purified, using methods known in the art, within recycle gas purifier 50. A method for purifying useful in the present process includes contacting the gaseous effluent 12 with an alkaline or amine solution at conditions and for a time sufficient to remove at least a portion of the $H_2S$ and $NH_3$ impurities from the gaseous effluent. Separation vessels useful for the present process are described in, for example, U.S. Pat. Nos. 4,925,573 and 5,082,551, the entire disclosures of which are incorporated herein by reference for all purposes.

The residuum feedstock 2 to the process of the present invention is generally a high boiling hydrocarbonaceous material having a normal boiling range mostly above 600° F., often having a normal boiling point range wherein at least 80% v/v of the feed boils between 600° F. and 1500° F., or between 800° F. and 1450° F. The residuum feedstock 2 further contains a high concentration of asphaltenes, and is therefore an unacceptable feedstock for hydrocracking without a preliminary hydrotreating step, as in the present invention. As used herein, asphaltenes may be determined as the normal-heptane insolubles content per ASTM D3279-90. Residuum feedstocks usefully processed in the present invention may contain more than 500 ppm asphaltenes or 1000 ppm asphaltenes, and may contain as much as 10,000 ppm asphaltenes or more. The residuum feedstocks also usually contain more than 10 ppm metals and greater than 0.1% by weight sulfur. The metals are believed to be present as organometallic compounds, but the concentrations of metals referred to herein are calculated as parts per million pure metal. The contaminating metals in the feed typically include nickel, vanadium and iron. The sulfur is present as organic sulfur compounds and the wt % sulfur is calculated based on elemental sulfur. Typical feedstocks for the present invention include deasphalted residua or crude, crude oil atmospheric distillation column bottoms (reduced crude oil or atmospheric column residuum), or vacuum distillation column bottoms (vacuum residua).

The hydrotreating reaction zone is maintained at conditions sufficient to remove at least a portion of any metal contaminants contained in the residuum feedstock and to reduce the sulfur content, the nitrogen content and the asphaltene content of the residuum feedstock. Typically, greater than 10%, and preferably greater than 25% w/w of the asphaltenes contained in the residuum feedstock 2 is removed during hydrotreating. A measure of cracking conversion may also occur, depending on the severity of the hydrotreating conditions. As used herein, conversion is related to a reference temperature, such as, for example, the minimum boiling point temperature of the feedstock. The extent of conversion relates to the percentage of feed boiling above the reference temperature that is converted during processing into products boiling below the reference temperature.

Hydrotreating conditions include a reaction temperature between 400° F.–900° F. (204° C.–482° C.), preferably 650° F.–850° F. (343° C.–454° C.); a pressure between 500 to 5000 psig (pounds per square inch gauge) (3.5–34.6 MPa), preferably 1000 to 3000 psig (7.0–20.8 MPa); a feed rate (LHSV) of 0.5 $hr^{-1}$ to 20 $hr^{-1}$ (v/v); and overall hydrogen consumption 300 to 2000 scf per barrel of liquid hydrocarbon feed (53.4–356 $m^3$ $H_2/m^3$ feed). The hydrotreating catalyst for the beds will typically be a composite of a Group VI metal or compound thereof, and a Group VIII metal or compound thereof supported on a porous refractory base such as alumina. Examples of hydrotreating catalysts are alumina supported cobalt—molybdenum, nickel sulfide, nickel—tungsten, cobalt—tungsten and nickel—molybdenum. Typically such hydrotreating catalysts are presulfided.

A hydrotreated liquid product 16 having reduced asphaltene content is recovered from the hydrotreating reaction zone 10 and is fractionated in first fractionation zone 30 to form at least a liquid converted stream and a stream containing unreacted or partially reacted material. The specific embodiment illustrated in the FIGURE includes a light gas product 32 (e.g. a desulfurized $C_4^-$ fraction), a desulfurized naphtha fraction 34, a desulfurized middle distillate fraction 36, a desulfurized vacuum gas oil 22 and desulfurized residuum fraction 38. At least a portion of one or more of fractions 32–36 may optionally be blended with other streams in the process for further processing. In the specific embodiment of the FIGURE, at least a portion of stream 32 may be combined with liquid hydrocrackate 28 for fractionation in second fractionation zone 40. At least a portion of desulfurized naphtha fraction 34, at least a portion of desulfurized diesel fraction 36 and/or at least a fraction of desulfurized VGO fraction 22 may be combined with recycle VGO 26 and passed to hydrocracking reaction zone 20. At least a fraction of desulfurized residuum fraction 38, which contains unreacted and partially reacted residuum feed, may be recycled to the hydrotreating reaction zone 10 for further hydrotreating through unreacted oil stream 39. Alternatively, desulfurized residuum fraction 38 may be sent to other refinery processes or blended into fuel oil.

A VGO (i.e. vacuum gas oil) feed 26, containing less than 500 ppm asphaltenes, preferably less than 200 ppm asphaltenes and more preferably less than 100 ppm asphaltenes, is passed to hydrocracking reaction zone 20 from second fractionation zone 40, and contacted with hydrocracker gaseous feed 6 at conditions sufficient to effect a boiling range conversion of the VGO feed. As used herein, asphaltenes may be determined as the normal-heptane insolubles content per ASTM D3279-90. Preferred hydrocracking conditions are sufficient to effect at least 20% conversion of the VGO feed, more preferably at least 30% conversion of the VGO feed, based on a 700° F. reference temperature, i.e. at least 20% of the VGO feed having a normal boiling point above the reference temperature is converted during hydrocracking to products having a normal boiling point below the reference temperature. Operating at conversion levels as high as 75% or even 100% (i.e. extinction recycle operation), based on the rate of VGO product stream 48 relative to the rate of VGO feed 26 is also within the scope of the invention. By "normal" is meant a boiling point or boiling range based on a distillation at one atmosphere pressure, such as that determined in a D1160 distillation. Unless otherwise specified, all distillation temperatures listed herein refer to normal boiling point and normal boiling range temperatures.

The hydrocracker gaseous feed 6 includes purified recycle gas 14 and make-up hydrogen gas 4. Purified recycle gas 14 is derived from gaseous hydrotreater effluent 12, a hydrogen-rich gaseous stream recovered from hydrotreating reaction zone 10, and purified in recycle gas purifier 50 to remove contaminate gases such as $H_2S$ and $NH_3$. Recycle gas purifier 50 further compresses the gaseous hydrotreater effluent 12 in preparation for using the gas as a hydrogen supply for hydrocracking reaction zone 20. Hydrocracker gaseous feed 6 is available as both a hydrogen source for blending with VGO feed 26 for passing to the hydrocracking reaction zone 20 and as a quench fluid for removing excess heat generated during reaction within hydrocracking reaction zone 20.

The hydrocracking reaction zone 20 may comprise one or more catalyst beds in one or more reactor vessels. Each catalyst bed may contain one or several different catalysts. In addition, the hydrocracking reaction zone 20 as shown in the FIGURE includes vessels for separating the hydrocracked effluent into at least a liquid hydrocrackate 28 and a hydrogen-rich gaseous stream 18. Hydrogen-rich gaseous stream 18 may optionally be purified, using methods known in the art, within hydrocracking reaction zone 20.

VGO feed 26 is a blend of recycle VGO 24 and desulfurized VGO fraction 22. Other VGO streams may also be added, including VGO streams originating from outside of the present process, so long as they do not contain unacceptable levels of hydrocracking catalyst poisons or foulants. VGO feed 26 may also optionally include at least a portion of additional streams from the first fractionation zone 30. In the preferred embodiment illustrated in the FIGURE, desulfurized naphtha fraction 34 and/or desulfurized middle distillate fraction 36 are shown. VGO product stream 48 from the second fractionation zone 40 contains oil which has not been sufficiently converted during hydrocracking for use as a source of middle distillate fuels. Such unconverted oil may optionally be used as finished products for in other refinery processes, such as, for example, lubricating oil base feedstock or FCC feedstock. As a lubricating oil base feedstock, it may be further treated, such as by solvent extraction, hydrocracking, hydrotreating, dewaxing, hydrofinishing or any combination thereof to prepare a lubricating oil base stock. Suitable processes for preparing a lubricating oil base stock are well known in the art, and do not require additional explanation here. At least a portion of product VGO stream 24 may be recycled to the hydrocracking reaction zone via stream 26, in combination with at least a portion of desulfurized VGO fraction 22. Optionally, all of product VGO stream 48 may be recycled.

The hydrocracking reaction zone is maintained at conditions sufficient to effect a boiling range conversion of the VGO feed 26 to the hydrocracking reaction zone, so that the liquid hydrocrackate 28 recovered from the hydrocracking reaction zone has a normal boiling point range below the boiling point range of the VGO feed 26. Typical hydrocracking conditions include: reaction temperature, 400° F.–950° F. (204° C.–510° C.), preferably 650° F.–850° F. (343° C.–454° C.); reaction pressure 500 to 5000 psig (3.5–34.5 MPa), preferably 1500–3500 psig (10.4–24.2 MPa); LHSV, 0.1 to 15 $hr^{-1}$ (v/v), preferably 0.25–2.5 $hr^{-1}$; and hydrogen consumption 500 to 2500 scf per barrel of liquid hydrocarbon feed (89.1–445 $m^3$ $H_2/m^3$ feed). The hydrocracking catalyst generally comprises a cracking component, a hydrogenation component and a binder. Such catalysts are well known in the art. The cracking component may include an amorphous silica/alumina phase and/or a zeolite, such as a Y-type or USY zeolite. The binder is generally silica or alumina. The hydrogenation component will be a Group VI, Group VII, or Group VIII metal or oxides or sulfides thereof, preferably one or more of molybdenum, tungsten, cobalt, or nickel, or the sulfides or oxides thereof. If present in the catalyst, these hydrogenation components generally make up from about 5% to about 40% by weight of the catalyst. Alternatively, platinum group metals, especially platinum and/or palladium, may be present as the hydrogenation component, either alone or in combination with the base metal hydrogenation components molybdenum, tungsten, cobalt, or nickel. If present, the platinum group metals will generally make up from about 0.1% to about 2% by weight of the catalyst.

Effluent from the hydrocracking reaction zone is separated into at least two streams, a liquid hydrocrackate stream 28 and a hydrogen-rich gaseous stream 18. The separation process may involve one or more flash separations or fractionations, each operated to maximize the recovery of high purity hydrogen from the effluent. One of the steps in the separation may be a process for scrubbing a gaseous hydrogen stream, using an absorbent such as water or an amine solution, to remove the hydrogen sulfide and ammonia which is generated during the hydrocracking reaction. Such scrubbing processes are well known. In the conventional process for recovering a high purity hydrogen stream, the product from the hydrocracker, including the hydrogen-containing gaseous streams, are cooled and/or depressurized to maximize recovery of hydrogen. One such process is disclosed in U.S. Pat. No. 5,082,551, the entire disclosure of which is incorporated herein by reference for all purposes. However, in the preferred embodiment of the present process, hydrogen-rich gaseous stream 18 is recovered from the hydrocracker zone effluent at substantially the same pressure as the hydrocracking reaction zone and at a high temperature approaching that of the hydrocracking reaction zone. It will be recognized that some reduction in temperature and pressure occurs during the separation processes, but heat and pressure losses are minimized in the process. In particular, hydrogen-rich gaseous stream 18 is maintained at a temperature of at least about 350° F. (177° C.), more preferably at least about 500° F. (260° C.) and most preferably at least about 650° F. (371° C.), up to the temperature of the hydrocracking reaction zone and a pressure from 500 to 5000 psig (3.5–34.5 MPa), preferably 1500–3500 psig (10.4–24.2 MPa). The hydrogen-rich gaseous stream 18 is passed, preferably without additional cooling, from hydrocracking reaction zone 20 to hydrotreating reaction zone 10 for contacting with residuum feedstock 2. In the most preferred embodiment, sufficient hydrogen is available in the hydrogen-rich gaseous stream 18 to supply the hydrogen requirements of the hydrotreating reaction zone 10, though additional hydrogen may be added as quench hydrogen from purified recycle gas stream 14 as required (not shown in the FIGURE).

Liquid hydrocrackate 28, optionally containing at least a portion of desulfurized $C_4^-$ fraction 32, is fractionated in second fraction zone 40. Zone 40 may comprise one or more flash separation units and/or one or more fractionation units, e.g. a first column operating at substantially atmospheric pressure and a second column for fractionating the bottoms from the first column, and operating at subatmospheric pressure. One or more product streams may be recovered from the second fractionation zone. Generally, at least three streams are collected, including a light overhead stream, a product stream and a stream comprising unreacted material from the hydrocracking reaction zone. In the present embodiment shown in the FIGURE, a $C_4^-$ product stream 42, a naphtha product stream 44, a middle distillate product stream, such as diesel, jet or kerosene 46 and a VGO product stream 48 are shown. Each of the product streams 42–48 may be used as produced as finished product, or may be processed further, depending on the needs of the refiner.

Reference is now made to the following example of a specific embodiment of the invention, which illustrates the benefit of the process of this invention.

A blended Arabian vacuum residuum feed (see Table I) was hydrotreated in a vacuum residuum hydrotreating unit.

TABLE 1

| Arabian Blend Vacuum Residuum Feed | |
|---|---|
| Degrees API | 4.6 |
| Specific Gravity, g/cc | 1.04 |
| Sulfur, Wt % | 5.73 |
| Nitrogen, Wt % | 0.47 |
| Nickel, ppmwt | 46 |
| Vanadium, ppmwt | 105 |
| Carbon Residue, Wt % | 24 |

Product yields from the hydrotreating step are shown in FIGURE Table II.

TABLE II

Yields and Product Properties from Residuum Hydrotreating Step

| Liquid Products | TBP Cut Points, ° F. | °API | LV % of VR Feed | Sulfur, Wt % |
|---|---|---|---|---|
| Light Naphtha | $C_5$-180 | 81.7 | 0.36 | 0.007 |
| Heavy Naphtha | 180–330 | 56.5 | 2.04 | 0.013 |
| Diesel | 330–690 | 31.9 | 13.46 | 0.068 |
| Desulfurized VGO | 690–1000 | 18.9 | 27.40 | 0.259 |
| VGO Product | 690–1000 | — | — | — |
| Desulfurized Residuum | 1000+ | 12.4 | 60.10 | 0.900 |
| Fuel Oil | 690+ | 14.4 | 87.51 | 0.705 |

The desulfurized vacuum gas oil product from the residuum hydrotreating step was hydrocracked to give the products shown in Table III.

TABLE III

Yields and Product Properties from Hydrocracking the Desulfurized VGO Product from the Residuum Hydrotreater

| Liquid Products | TBP Cut Points, ° F. | °API | LV % of Desulfurized VGO Feed | Sulfur, ppmwt |
|---|---|---|---|---|
| Light Naphtha | $C_5$-180 | 80.0 | 8.51 | <5 |
| Heavy Naphtha | 180–330 | 54.0 | 23.99 | <5 |
| Diesel | 330–690 | 40.0 | 74.80 | <5 |
| Desulfurized VGO | 690–1000 | — | — | — |
| VGO Product | 690–1000 | 32.3 | 5.00 | 50 |
| Desulfurized Residuum | 1000+ | — | — | — |
| Fuel Oil | 690+ | — | — | — |

In Table IV the yields and product properties for the overall integrated process are listed. The benefit of the present invention can be seen by a comparison between the columns entitled "LV % of VR Feed" in Table II and in Table IV. Table II lists data for the comparative case, with residuum hydrotreating without hydrocracking. Table IV lists data for the invention. Including hydrocracking in the integrated process resulted in significantly higher yields of naphtha and diesel, the desired products of the process, and much lower fuel oil yields.

TABLE IV

Overall Yields and Product Properties from the Combined Process of this Invention

| Liquid Products | TBP Cut Points; ° F. | °API | LV % of VR Feed | Sulfur, Wt % |
|---|---|---|---|---|
| Light Naphtha | $C_5$-180 | 80.2 | 2.69 | 0.001 |
| Heavy Naphtha | 180–330 | 54.6 | 8.61 | 0.003 |
| Diesel | 330–690 | 36.7 | 33.95 | 0.030 |
| Desulfurized VGO | 690–1000 | — | — | — |
| VGO Product | 690–1000 | 32.3 | 1.37 | 0.005 |
| Desulfurized Residuum | 1000+ | 12.4 | 60.10 | 0.900 |
| Fuel Oil | 1000+ | 12.4 | 60.10 | 0.900 |

Table V shows that the cetane number of the diesel product was much higher for the integrated process than for the comparative process using only residuum hydrotreating.

TABLE V

| | Cetane Index |
|---|---|
| Residuum hydrotreating only | 45+ |
| Hydrocracking process | 60+ |
| Process of the invention | 55+ |

Although only specific embodiments of the present invention have been described, numerous variation can be made in these embodiments without department from the sprit of the invention and all such variations that fall within the scope of the appended claims are intended to be embraced thereby.

What is claimed is:

1. An integrated hydroconversion process comprising:

a) contacting a residuum feedstock with a hydrogen-rich gaseous stream in a hydrotreating reaction zone to form a hydrotreated liquid product having reduced asphaltene content and a gaseous hydrotreater effluent;

b) fractionating the hydrotreated liquid product in a first fractionation zone to recover at least a desulfurized VGO fraction;

c) contacting a VGO feed with a gaseous hydrocracker feed stream in a hydrocracking reaction zone, at hydrocracking conditions sufficient to effect a boiling range conversion of the VGO feed, to produce at least the hydrogen-rich gaseous stream and a liquid hydrocrackate;

d) passing the hydrogen-rich gaseous stream to the hydrotreating reaction zone for contacting with the residuum feedstock;

e) fractionating the liquid hydrocrackate in a second fractionation zone to recover at least a VGO product stream; and f) combining the desulfurized VGO fraction with at least a portion of VGO product stream to form the VGO feed for contacting in the hydrocracking reaction zone.

2. The process according to claim 1 wherein the hydrocracking reaction zone is maintained at hydrocracking reaction conditions, including a reaction temperature of between 400° F. to 950° F. (204° C.–510° C.), a total pressure of 500 to 5000 psig (3.5–34.5 MPa), and feed rate (LHSV) of 0.1 to 15 $hr^{-1}$ (v/v), and a hydrogen consumption of 500 to 2500 scf per barrel of liquid hydrocarbon feed (89.1–445 $m^3$ $H_2/m^3$ feed).

3. The process according to claim 2 wherein the hydrogen-rich gaseous stream is passed to the hydrotreating reaction zone at a temperature of at least about 350° F. (177° C.).

4. The process according to claim 2 wherein the hydrocracking reaction zone is maintained at conditions sufficient to effect at least 20% conversion of the VGO feed.

5. The process according to claim 1 wherein the hydrotreated liquid product is fractionated in a first fractionation zone to form a desulfurized $C_4^-$ fraction, a desulfurized naphtha fraction, a desulfurized diesel fraction, a desulfurized VGO fraction and a desulfurized residuum fraction.

6. The process according to claim 1 wherein the liquid hydrocrackate is fractionated in a second fractionation zone to form a $C_4^-$ product stream, a naphtha product stream, a diesel product stream and a VGO product stream.

7. The process according to claim 5 wherein the VGO feed further comprises at least a portion of the desulfurized naphtha fraction.

8. The process according to claim 5 wherein the VGO feed further comprises at least a portion of desulfurized diesel fraction.

9. The process according to claim 7 wherein the VGO feed further comprises at least a portion of desulfurized diesel fraction.

10. The process according to claim 1 wherein the hydrotreating reaction zone is maintained at conditions sufficient to remove at least a portion of the asphaltenes from the residuum feedstock, including a reaction temperature of between 400° F.–900° F. (204° C.–482° C.), a pressure between 500 to 5000 psig (pounds per square inch gauge) (3.5–34.6 MPa), a feed rate (LHSV) of 0.5 $hr^{-1}$ to 20 $hr^{-1}$ (v/v); and an overall hydrogen consumption 300 to 2000 scf per barrel of liquid hydrocarbon feed (53.4–356 $m^3$ $H_2/m^3$ feed).

11. The process according to claim 10 wherein the residuum feedstock is selected from the group consisting of deasphalted residua, deasphalted crude oil, crude oil atmospheric distillation column bottoms, or crude oil vacuum distillation column bottoms.

12. The process according to claim 5 wherein the residuum feedstock contains greater than 500 ppm asphaltenes.

13. The process according to claim 12 where the hydrotreated liquid product contains less than 250 ppm asphaltenes.

14. The process according to claim 1 wherein unreacted hydrogen in the hydrotreater gaseous effluent is purified to remove contaminants and combined with a make-up hydrogen stream for passage to the hydrocracking reaction zone.

* * * * *